United States Patent [19]

Suzuki et al.

[11] Patent Number: 5,061,384

[45] Date of Patent: Oct. 29, 1991

[54] HEAT-RESISTANT LUBRICANT COMPOSITIONS FOR PROCESSING SYNTHETIC FIBERS

[75] Inventors: Akira Suzuki; Masato Sugiura, both of Aichi, Japan

[73] Assignee: Takemoto Yushi Kabushiki Kaisha, Aichi, Japan

[21] Appl. No.: 631,176

[22] Filed: Dec. 19, 1990

Related U.S. Application Data

[63] Continuation of Ser. No. 522,090, May 11, 1990, abandoned, which is a continuation-in-part of Ser. No. 420,739, Oct. 12, 1989, abandoned, which is a continuation-in-part of Ser. No. 252,371, Sep. 30, 1987, abandoned.

[30] Foreign Application Priority Data

Sep. 30, 1987 [JP] Japan ..... 62-248943

[51] Int. Cl.[5] ..... D06M 11/00; C10M 157/10

[52] U.S. Cl. ..... 252/8.9; 252/32.7 R; 252/49.6; 252/52 A

[58] Field of Search ..... 252/8.9, 32.7 R, 49.6, 252/524

[56] References Cited

U.S. PATENT DOCUMENTS

| | | | |
|---|---|---|---|
| 4,038,258 | 7/1977 | Singh et al. | 428/395 |
| 4,351,738 | 9/1982 | Takahashi et al. | 252/8.9 |
| 4,552,671 | 11/1985 | Ogiso et al. | 252/8.9 |
| 4,561,987 | 12/1985 | Yamamoto et al. | 252/8.9 |
| 4,702,741 | 10/1987 | Dexheimer | 252/8.9 |

*Primary Examiner*—Prince E. Willis
*Assistant Examiner*—Jerry D. Johnson
*Attorney, Agent, or Firm*—Heller, Ehrman, White & McAuliffe

[57] ABSTRACT

A heat-resistant lubricant composition for processing synthetic fibers includes 85% or more by weight of polyether compound of molecular weight between 500 and 10000 derivable from alkylene oxide with 2–4 carbon atoms and an organic compound having at least one active hydrogen in its molecule, 0.2–5% by weight of modified polysiloxane of molecular weight 2500 or greater modified by propylene oxide and/or ethylene oxide, and 0.05–10% by weight of phosphonium sulfonate of a specified structure.

3 Claims, No Drawings

HEAT-RESISTANT LUBRICANT COMPOSITIONS FOR PROCESSING SYNTHETIC FIBERS

This is a continuation of application Ser. No. 07/522,090 filed May 11, 1990 now abandoned, which is a continuation-in-part of application Ser. No. 07/420,739 filed Oct. 12, 1989, now abandoned, which is a continuation-in-part of application Ser. No. 07/252,371 filed Sept. 30, 1987, now abandoned.

BACKGROUND OF THE INVENTION

This invention relates to heat-resistant lubricant compositions for processing synthetic fibers.

In general, a lubricant is attached to thermoplastic synthetic fibers such as polyester, polyamide and polypropylene immediately after they are melted and spun. After they are made into drawn yarns with different forms and characteristics, they are further subjected to higher-order processes to obtain final products. Recently, the trend has been to speed up these production and processing steps and, in order to improve productivity by using energy-saving means in the production and processing steps of thermoplastic synthetic fibers or by making such steps shorter, attempts are being made to produce partially oriented yarns (POY) and to carry out drawing and false twisting successively or simultaneously by using the POY to thereby produce textured yarns. Currently, there are increasing attempts to speed up these processes but, as the speed of these processes increases, there arise at the same time the needs for a new kind of lubricant which satisfy the following two conditions. One of these conditions to be satisfied is that the lubricant must be able to provide high degrees of lubricity, cohesiveness and antistatic characteristics to feed yarns for false twisting and, in particular, to feed yarns for drawing and false twisting because there is an increase not only in the speed of yarns running in contact with rollers, guides, heaters for heat treatments, disks and the like (hereinafter simply referred to as contact members) but also their contact pressure against them. The other condition to be satisfied relates to the increased amount of substances of all kinds which fall onto the heater because more yarns pass through the heater per unit time and the centrifugal force associated with the twisting of the yarns is also increased. Since both the length of the heater and its surface temperature are increased in order to supply sufficient heat to filaments for winding and securing, furthermore, these substances are degraded more easily. Such thermally degraded substances (such as tar) cause fluffs, yarn breakage, and other ill-effects if they pile up on the heater surface. In view of the above, the lubricant must be able to reduce the amount of substances falling onto the heater.

In the past, many kinds of lubricant compositions containing an ionic or nonionic surfactant as antistatic agent have been used for the processing of synthetic fibers. With conventional lubricant compositions for synthetic fibers, however, the mixing ratio of the antistatic agent must be increased if a high antistatic characteristic is desired. In this case, if the ionic surfactant is sodium alkane sulfonate, potassium alkyl phosphate or the like having metallic ions as counter ions, for example, it lacks in compatibility with the lubricant composition and tends to be rejected from the lubricant system. As a result, it is easily dropped during processing and piled up, thereby increasing the contact friction between fibers and the contact members, causing an increase in the tension, damage to the fibers, fluffs and yarn breakage, and significantly affecting work efficiency and the yarn quality adversely. If the substances which fall off are piled up on the heater for heat treatment and become thermally degraded (such as when tar is generated), the situation is even worse. If the mixing ratio of ionic surfactant is reduced in order to reduce the amount of substances which fall off and become degraded, or if use is made of a nonionic surfactant which is relatively compatible with lubricant compositions, on the other hand, antistatic characteristics cannot be attained as desired and there arise problems due to generated static electricity such as disheveling of filaments, swinging motion of yarns and their wrapping around the rollers. Thus, processability and yarn quality are also adversely affected.

Use of ionic surfactants not having metallic ions as counter ions has been disclosed, for example, in U.S. Pat. Nos. 4,038,258 and 4,506,070 (use of various phosphonium salts) and U.S. Pat. No. 2,837,446 (use of N substituted phosphonium salts). Japanese Patent Publication Tokkai 56-31077 has disclosed the use of polyether compounds for the specific purpose of improving heat resistance. U.S. Pat. Nos. 4,552,671 and 4,561,987 have disclosed the mixing of a polyether compound with polyoxyalkylene modified polysiloxane and an anionic surfactant such as sulfonates, sulfates, phosphates and carboxylates having an alkali metal salt or organic amine salt as counter ions. None of these prior art examples, however, can be a solution to the aforementioned problems as a whole although there are differences in degree among them.

SUMMARY OF THE INVENTION

It is therefore an object of the present invention in view of the above to solve the aforementioned problems of prior art compounds and to provide heat-resistant lubricant compounds for the processing of synthetic fibers with which severe requirements of the present day can be satisfied. In other words, the main object of the present invention is to provide heat-resistant lubricant compounds for the processing of synthetic fibers which can substantially satisfy requirements regarding not only lubricity, cohesiveness and anti-static capability but also contamination of heater.

The present invention was accomplished by the present inventors as a result of their diligent studies in view of the above and other objects and is based on their discovery that lubricant compositions comprising specified amounts of a polyether compound, modified polysiloxane and phosphonium sulfonate of specified structures satisfy the desired conditions.

DETAILED DESCRIPTION OF THE INVENTION

Heat-resistant lubricant compositions according to the present invention for processing synthetic fibers are characterized as comprising 85% or more by weight of a mixture consisting of polyether compound A of molecular weight between 500 and 2500 and polyether compound B of molecular weight between 5000 and 10000 at weight ratio of 5/5 - 2/8, both polyether compound A and polyether compound B being derived from alkylene oxide having 2–3 carbon atoms and monovalent-quadrivalent alcohol having 1–18 carbon atoms which is shown by the formula

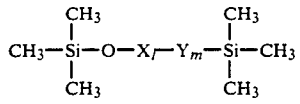

and has average molecular weight of 2500 or greater where X is

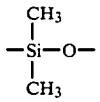

1 is an integer from 20 to 100, and Y is

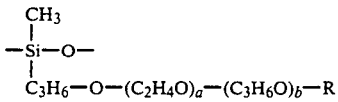

where R is hydrogen or alkyl group with 1 to 8 carbon atoms, a and b are integers satisfying the relations $15 \leqq a+b \leqq 80$ and $2/8 \leqq b/a \leqq 8/2$, m is an integer from 1 to 9 and the repetition of X and Y and the repetition of $(C_2H_4O)$ and $(C_3H_6O)$ in Y may be either block or random repetition

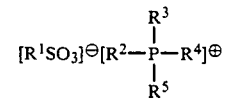

where $R^1$ is phenyl group substituted by alkyl group with 1–18 carbon atoms or alkyl group with 4–18 carbon atoms, and $R^2$–$R^5$ are same or different, each being phenyl group or alkyl group with 1–12 carbon atoms.

According to the present invention, the mixed polyether compounds which are the principal components of lubricants serving as the base oil according to the present invention, must provide adhesion of yarn bundle during fiber manufacturing processes, show excellent lubricating effects under severe conditions of false twist texturing and itself produce hardly any degraded substances generated by heating. The aforementioned mixed polyether compounds are a mixture consisting of what is herein referred to as "polyether compound A" having molecular weight in the range between 500 and 2500 and what is herein referred to as "polyether compound B" having molecular weight in the range between 5000 and 10000 at weight ratio (A/B) of 5/5 - 2/8. Polyether compound A has the effect of improving lubricity under the conditions of normal temperatures and high speed while polyether compound B has the effect of improving lubricity under high-temperature conditions. In order to prevent yarn breakage caused by insufficient lubricity in false twist processing, the requirement for lubricity must be satisfied under both of these different conditions. To this end, use is made, according to the present invention, of a mixture of polyether compounds A and B at weight ratio (A/B) in the range of 5/5 - 2/8. If the average molecular weight is less than 500, fuming characteristics, adhesion of yarn and lubricating ability tend to deteriorate in false twist or draw-false twist texturing process. Also, if the average molecular weight is more than 100,000, lubricating ability becomes poor at high speeds. They can be those obtainable in the presence of a catalyst by ring-opening block or random addition polymerization of cyclic ether monomers such as EO and PO to alcohols (monohydric alcohols such as saturated alcohols with 1 to 18 carbon atoms, oleyl alcohol, synthetic alcohols with 10 to 15 carbon atoms, reductive alcohols and hexadecanol, diol with 2 to 12 carbon atoms, polyhydric alcohols such as glycerol, trimethylol propane and pentaerythritol, etc.). The ratio between EO and PO to be added to alcohol is preferably in the range of EO/PO=90/10 - 10/90 by weight according to the purpose of the use.

According to the present invention, the modified polysiloxane is added as an indispensable constituent but the following 5 conditions must be satisfied:

(1) Molecular weight must be no less than 2500;
(2) Number of repetitions of X(1) must be 20 to 100;
(3) Number of repetitions of Y(m) must be 1 to 9;
(4) The alkylene oxide chain in Y is a block or random repetition of EO and PO; and
(5) Number of EO repetitions a and that of PO repetitions b must satisfy the conditions $15 \leqq a+b \leqq 80$ and $2/8 \leqq b/a \leqq 8/2$.

As for modified polysiloxane, it can be synthesized, for example, by the hydrosilylation between compounds of groups (i) and (ii) below:

(i) Allyloxy polyalkoxy ($C_{2-3}$) ether or alkoxy ($C_{1-8}$) ether thereof; and
(ii) Methyl hydrogen polysiloxane having random or block positioned hydrogen atoms

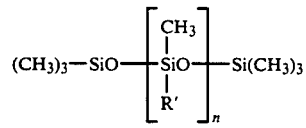

where R's are a random or block positioned mixture of $CH_3$ and H.

Phosphonium sulfonate according to the present invention may be any combination of an organic sulfonate anion and an organic phosphonium cation. Regarding the above, examples of organic sulfonate anion include aliphatic alkyl sulfonate anions such as lauryl sulfonate, stearyl sulfonate and their mixtures, as well as alkyl group substituted phenyl sulfonate anion such as dodecylphenyl sulfonate. Examples of organic phosphonium cation include aliphatic phosphonium cations such as tetramethyl phosphonium, tetrabutyl phosphonium, trioctylmethyl phosphonium, trimethyllauryl phosphonium and trimethyloctyl phosphonium and aromatic phosphonium cations such as triphenylmethyl phosphonium.

As stated above, heat-resistant lubricant compositions of the present invention are characterized not only as having three constituents which are a polyether compound, modified polysiloxane and phosphonium sulfonate but also as having them within specified ranges of weight percentages, that is, a polyether compound must be contained by 85% or more by weight, modified polysiloxane must be contained by 0.2–5% by weight, and phosphonium sulfonate must be contained by 0.05–10% or preferably by 0.1–5% by weight. Only if the aforementioned three constituents are contained at a ratio within the range specified above, the lubricant composition exhibits the desired characteristics as a whole.

Heat-resistant compositions of the present invention can be applied to fiber yarns as a 5-30wt% aqueous solution or emulsion at a rate of 0.1-5wt% or preferably 0.2-3wt% (converted with respect to effective composition). Methods of application which may be used include the roller touch method, the guide oiling method and the spraying method. In what follows, test examples of the present invention are described but they are not intended to limit the scope of the present invention.

TEST EXAMPLES

Polyethylene terephthalate of intrinsic viscosity 0.68 was spun out of a capsule with 36 holes by a melting spinning method and after a 10wt% emulsion of each of the lubricant compositions described in connection with Table 1 was attached to it by a roller touch method at the rate of 0.4±0.1 wt% (converted with respect to effective component), it was wound up at the speed of 3300m/min to obtain a 12kg rolled cake of 115 denier/36 filament partially oriented yarn (POY) of polyester. Next, this POY was simultaneously processed by drawing and false-twisting under the following conditions to obtain processed 75 denier/36 filament polyester yarn.

Conditions of simultaneous drawing and false-twisting

Twisting system: Three-axis friction methods with urethane disk
Speed of winding yarns: 650m/min
Draw ratio: 1.518
Heater on twist side: Length =2.5m Surface temperature =220° C.
Heater on untwisting side: None
Intended number of twisting: 3200T/m Occurrence of yarn breakage, contamination of the heater surface and static electricity generated on the yarns at the time of drawing and false twisting were evaluated as follows by a continuous operation for 72 hours. The results are shown in Table 1.

Evaluation of yarn breakage

Occurrence of yarn breakage during a continuous operation for 72 hours was evaluated as follows:
A: No yarn breakage (Pass)
B: Yarn breakage once
C: Yarn breakage 2 or 3 times
D: Yarn breakage 4 or more times

Evaluation of contamination of heater surface

Contamination of a heater surface after a continuous operation for 72 hours was evaluated as follows:
A: Hardly any contamination (Pass)
B: Extremely small amount of contamination
C: Small amount of contamination
D: Large amount of contamination

Evaluation of generated static electricity (Voltage)

Static electricity generated on the running yarns was measured by a Kasuga static electrometer immediately after the yarns passed the twisting apparatus (with a urethane disk) during the simultaneous processing of drawing and false twisting. The measured results were evaluated as follows:
A: Less than 100V (Pass)
B: 100V or more but less than 300V (Pass)
C: 300V or more but less than 500V
D: 500V or more Generated electricity was negative. Absolute values were considered in the evaluation.

Table 1 clearly shows that the present invention provides heat-resistant lubricant compositions which are superior regarding lubricity, cohesiveness and antistatic characteristics and do not contaminate the heater surface, thereby making it possible to obtain high-quality products under improved processability conditions.

TABLE 1

| | Test Examples | | | | | | | Comparison Examples | | | | | | | | | | | | | | | | | | |
|---|---|---|---|---|---|---|---|---|---|---|---|---|---|---|---|---|---|---|---|---|---|---|---|---|---|---|
| | 1 | 2 | 3 | 4 | 5 | 6 | 7 | 1 | 2 | 3 | 4 | 5 | 6 | 7 | 8 | 9 | 10 | 11 | 12 | 13 | 14 | 15 | 16 | 17 | 18 | 19 |
| A-1 | | | | | | | | 15 | 11 | | | | | | | | | | | | | | | | | |
| A-2 | | | | | | | | 15 | 10 | | | | | | | | | | | | | | | | | |
| A-3 | | | | | | | | | | | | 94 | | | | | | | | | | | | | | |
| A-4 | 34 | 36 | 36 | 28 | 34 | 24 | 44 | 30 | 20 | 30 | 34 | 40 | 30 | | | 34 | | 34 | 34 | 34 | | 34 | 34 | 34 | 60 | 10 |
| A-5 | 60 | 60 | 60 | 60 | 60 | 70 | 50 | | 30 | 59 | 64 | 60 | 40 | | | 60 | | 60 | 60 | 60 | | 60 | 60 | 60 | 34 | 84 |
| A-6 | | | | | | | | | | | | | | | 94 | | | | | | | | | | | |
| A-7 | | | | | | | | | | | | | | | | | | | | | 96.8 | | | | | |
| A-8 | | | | | | | | | | | | | | | | | 40 | | | | | | | | | |
| A-9 | | | | | | | | | | | | | | | | | 16 | | | | | | | | | |
| A-10 | | | | | | | | | | | | | | | | | 30 | | | | | | | | | |
| B-1 | | | | | | | | 20 | 13 | 5 | | | 10 | | | | | | | | | | | | | |
| B-2 | | | | | | | | 14 | 10 | | | | 5 | | | | | | | | | | | | | |
| C-1 | | | | | | | | 6 | 6 | | | | | | | | | 4 | | | | | | | | |
| C-2 | 4 | 2 | | | | | | | | | | | 15 | 4 | 4 | 4 | | | | | | | | | | |
| C-3 | | | 2 | 8 | 4 | 4 | 4 | | | | | | | | | | | | | | | | | | 4 | 4 |
| C-4 | | | | | | | | | | | | | | | | | | | 4 | | | | | | | |
| C-5 | | | | | | | | | | | | | | | | | | | | 4 | | | | | | |
| C-6 | | | | | | | | | | | | | | | | | | | | | | 4 | | | | |
| C-7 | | | | | | | | | | | | | | | | | | | | | | | 4 | | | |
| C-8 | | | | | | | | | | | | | | | | | | | | | | | | 4 | | |
| C-9 | | | | | | | | | | | | | | | | | | | | | 3 | | | | | |
| D-1 | | | | | | | | | | 6 | 2 | | | | | | | | | | | | | | | |
| D-3 | | | | | | | | | | | | | | | | | 2 | | | | | | | | | |
| D-4 | | | | | | | | | | | | | | | | | 2 | | | | | | | | | |
| E-1 | 2 | 2 | 2 | 4 | 2 | 2 | 2 | | | | | | | 2 | 2 | | | 2 | 2 | 2 | | 2 | 2 | 2 | 2 | 2 |
| E-2 | | | | | | | | | | | | | | | | 2 | | | | | | | | | | |
| E-3 | | | | | | | | | | | | | | | | | | | | | 0.2 | | | | | |
| E-4 | | | | | | | | | | | | | | | | | 10 | | | | | | | | | |
| Breakage: | A | A | A | A | A | A | A | B | B | D | C | D | C | C | C | D | B | B | C | B | B | D | C | C | C | C |
| Contamination: | A | A | A | A | A | A | A | B | B | D | C | A | C | B | B | C | B | B | C | B | B | C | C | C | C | A |

TABLE 1-continued

| | | | | | | | | | | | | | | | | | | | | | | | | | |
|---|---|---|---|---|---|---|---|---|---|---|---|---|---|---|---|---|---|---|---|---|---|---|---|---|---|
| | | | | | | | | | | | | | Voltage: | | | | | | | | | | | | |
| A | AB | AB | A | A | A | A | A | A | C | D | D | A | AB | AB | A | B | A | B | AB | B | B | B | C | A | A |

Notes:

A-1: Octyl stearate
A-2: POE (10 mole)-1,4-butandiol dilaurate
A-3: Polyoxy alkylene glycol (PO/EO = 50/50, MW = 300, random)
A-4: Polyoxy alkylene monobutylether (PO/EO = 50/50, MW = 1500, block)
A-5: Polyoxy alkylene glycol (PO/EO = 60/40, MW = 6000, random)
A-6: Polyoxy alkylene glycol (PO/EO = 20/80, MW = 15000, random)
A-7: ω-methoxy (polyoxy alkylene trimethylolpropane ether), PO/EO = 75/25 by weight, MW = 2000,
A-8: Polyoxy alkylene trimethylolpropane ether, PO/EO = 85/15 by weight, MW = 3500,
A-9: Polyoxy alkylene lauryl ether, PO/EO = 40/60 by weight, MW = 1800,
A-10: Polyoxy ethylene (n = 7) octylether octanate,
B-1: POE (10 mole) laurylether
B-2: POE (5 mole) nonylphenylether C-1: $[C_{12}H_{25}SO_3]^{\ominus}[HOH_4C_2-\underset{\underset{C_2H_4OH}{|}}{\overset{\overset{C_2H_4OH}{|}}{P}}-C_4H_9]^{\oplus}$ C-2: $[C_{12}H_{25}SO_3]^{\ominus}[C_4H_9-\underset{\underset{C_4H_9}{|}}{\overset{\overset{C_4H_9}{|}}{P}}-C_4H_9]^{\oplus}$ C-3: 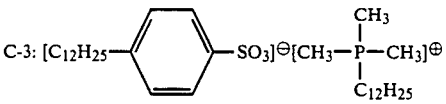

C-4: Tetra-n-butylphosphonium diphenylphosphonate,
D-1: Sodium dodecane sulfonate
D-2: Potassium lauryl phosphate
D-3: Potassium salt of polyoxypropylene (n = 4) octylphosphate,
D-4: Triethanolamine salt of isostearic acid,
E-1: Modified polysiloxane with MW = 16188 shown below:

$$CH_3-\underset{\underset{CH_3}{|}}{\overset{\overset{CH_3}{|}}{Si}}-O(SiO)_{50}(\underset{\underset{C_3H_6O[(PO)_{15}(EO)_{15}]C_8H_{17}}{|}}{\overset{\overset{CH_3}{|}}{SiO}})_7\underset{\underset{CH_3}{|}}{\overset{\overset{CH_3}{|}}{Si}}-CH_3$$

E-2: Modified polysiloxane with MW = 1817 shown below:

$$CH_3-\underset{\underset{CH_3}{|}}{\overset{\overset{CH_3}{|}}{Si}}-O(SiO)_5(\underset{\underset{C_3H_6O[(PO)_5(EO)_5]CH_3}{|}}{\overset{\overset{CH_3}{|}}{SiO}})_2\underset{\underset{CH_3}{|}}{\overset{\overset{CH_3}{|}}{Si}}-CH_3$$

E-3: Polyoxyalkylene modified polysiloxane having following formula $$CH_3-\underset{\underset{CH_3}{|}}{\overset{\overset{CH_3}{|}}{SiO}}\left(\underset{\underset{CH_3}{|}}{\overset{\overset{CH_3}{|}}{SiO}}\right)_{50}\left(\underset{\underset{C_3H_6-O\left(PO)_{15}(EO)_{15}\right)CH_3}{|}}{\overset{\overset{CH_3}{|}}{SiO}}\right)_7\underset{\underset{CH_3}{|}}{\overset{\overset{CH_3}{|}}{Si}}-CH_3$$

Regarding E-1 and E-2, the repetition of the poly (dimethyl siloxane) part and the poly (oxyalkylene) modified polysiloxane part and the repetition of the poly (oxypropylene=PO) part and the poly (oxyethylene=EO) part are both random.

What is claimed is:

1. A heat-resistant lubricant composition for processing synthetic fibers comprising 85% or more by weight of a mixture consisting of polyether compound A of molecular weight between 500 and 2500 and polyether compound B of molecular weight between 5000 and 10000 at weight ratio of 5/5 - 2/8, both said polyether compound A and said polyether compound B being derived from alkylene oxide having 2-3 carbon atoms and monovalent-quadrivalent alcohol having 1-18 carbon atoms.

0.2 - 5% by weight of modified polysiloxane which is shown by the formula $$CH_3-\underset{\underset{CH_3}{|}}{\overset{\overset{CH_3}{|}}{Si}}-O-X_l-Y_m-\underset{\underset{CH_3}{|}}{\overset{\overset{CH_3}{|}}{Si}}-CH_3$$

and has average molecular weight of 2500 or greater where X is

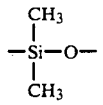

1 is an integer from 20 to 100, and Y is

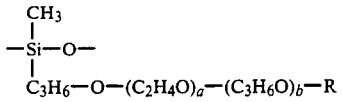

where R is hydrogen or alkyl group with 1-8 carbon atoms, a and b are integers satisfying $15 \leqq a+b \leqq 80$ and $2/8 \leqq b/a \leqq 8/2$, m is an integer from 1 to 9 and the repetition of X and Y and the repetition of $(C_2H_4O)$ and $(C_3H_6O)$ in Y may be either block or random repetition, 0.05-10% by weight of phosphonium sulfonate shown by the formula

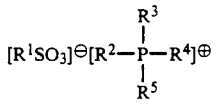

where $R^1$ is phenyl group substituted by alkyl group with 8-18 carbon atoms or alkyl group with 12-18 carbon atoms, and $R^2$-$R^5$ are same or different, each being phenyl group or alkyl group with 1-12 carbon atoms.

2. The composition of claim 11 wherein said phosphonium sulfonate is selected from tetrabutyl phosphonium dodecyl sulfonate.

3. The composition of claim 1 wherein said phosphonium sulfonate shown by said formula is contained by 0.1-5% by weight.

* * * * *